US005238512A

United States Patent [19]

Persson

[11] Patent Number: 5,238,512

[45] Date of Patent: Aug. 24, 1993

[54] WATER RESISTANT ELASTIC EXPLOSIVE MIXTURE

[75] Inventor: Ingemar Persson, Nora, Sweden

[73] Assignee: Exploweld AB, Nora, Sweden

[21] Appl. No.: 535,993

[22] Filed: Jun. 11, 1990

Related U.S. Application Data

[63] Continuation of Ser. No. 303,729, Jan. 23, 1989, abandoned.

[30] Foreign Application Priority Data

Jun. 4, 1987 [SE] Sweden ..... 8702352

[51] Int. Cl.[5] ..... C06B 45/10

[52] U.S. Cl. ..... 149/19.2; 149/11; 149/2; 149/19.1

[58] Field of Search ..... 149/11, 19.1, 19.2, 149/2

[56] References Cited

U.S. PATENT DOCUMENTS

| | | | |
|---|---|---|---|
| 2,067,213 | 1/1937 | Snelling | 52/2 |
| 3,104,995 | 9/1963 | Reynolds et al. | 149/19.9 |
| 3,138,496 | 6/1964 | Monical | 149/11 |
| 3,151,010 | 9/1964 | Bice | 149/19 |
| 3,296,041 | 1/1967 | Wright | 149/2 |
| 3,338,764 | 8/1967 | Evans | 149/19.9 |
| 3,348,986 | 10/1967 | Sauer | 149/11 |
| 3,376,175 | 4/1968 | Sheeline | 149/19.1 |
| 3,428,502 | 2/1969 | Evans | 149/19.9 |
| 3,619,306 | 11/1971 | Berthmann et al. | 149/18 |
| 3,706,609 | 12/1992 | Voigt et al. | 149/18 |
| 4,019,932 | 4/1977 | Schroeder | 149/19.1 |
| 4,047,990 | 9/1977 | Falterman et al. | 149/19.2 |
| 4,088,518 | 5/1978 | Kehren et al. | 149/19.2 |
| 4,092,187 | 5/1978 | Hildebrant et al. | 149/11 |
| 4,145,972 | 3/1979 | Menz et al. | 102/270 |
| 4,163,681 | 8/1979 | Rothenstein et al. | 149/11 |
| 4,445,948 | 5/1984 | Stanton et al. | 149/19.91 |
| 4,699,741 | 10/1987 | Back et al. | 149/11 |
| 4,706,567 | 11/1987 | Schmid et al. | 102/318 |
| 4,718,347 | 1/1988 | Schmid et al. | 102/310 |

FOREIGN PATENT DOCUMENTS

| | | |
|---|---|---|
| 0208665 | 1/1987 | European Pat. Off. . |
| 2027709 | 2/1978 | Fed. Rep. of Germany . |
| 0153452 | 12/1985 | Norway . |

OTHER PUBLICATIONS

Hawley, *The Condensed Chemical Dictionary*, 9th Ed., pp. 501, 757 and 758, Van Nostrand Reinhold (1977) New York.

*Primary Examiner*—Edward A. Miller
*Attorney, Agent, or Firm*—Nies, Kurz, Bergert & Tamburro

[57] ABSTRACT

An explosive composition comprises one or several self-detonating explosives, such as PETN, HMX, TNT or RDX, desensitized by wax or water and one or several inert materials. The invention is characterized in that the inert material or a part thereof consists of a rubber of the type silicone rubber or latex rubber, which inert material constitutes matrix or binding agent. The components after being mixed together constitute a composition, which can be cast, extruded or rolled-out.

8 Claims, No Drawings

WATER RESISTANT ELASTIC EXPLOSIVE MIXTURE

This application is a continuation of U.S. Ser. No. 303,729, filed Jan. 23, 1989, and now abandoned.

This invention relates to a water-resistent elastic explosive material.

It is known that explosive materials containing a self-detonating explosive, as the example PETN, HMX, RDX or TNT, can be manufactured with casting plastics as matrix.

The manufacture of these so-called PBX-explosives, however, is expensive and complicated, due to the fact, that the self-detonating explosives must be added in sensitized state, because the curing process of the plastic material is affected considerably by existing desensitizing agents, such as wax, oil or water.

Owing to their high sensitivity and the risks associated therewith, the handling of sensitized explosives is complicated and requires special premises and special equipment, which limits the rate of production.

The mouldable plastics, as a rule, are per se injurous to health and, therefore, require effective protective equipment. When the temperature in the cast compound is not kept under accurate control, local temperature increases can be so high that the explosive reacts, resulting in an explosion. The PBX-explosives at their detonation or combustion also yield products which are injurious to health to corrosive.

Explosive material according to the present invention can be manufactured and used without the aforesaid disadvantages and risks.

One desire is to be able to work with desensitized explosive. It is, however, not possible to use mouldable plastics as matrix material when the desensitizing agent is, for example, oil or wax, because such plastics solve the desensitizing agent. Water can also be used as desensitizing agent, but for example water-desensitized pentyl together with a mouldable plastic gives rise to a substantial increase in volume.

The present invention, however, renders it possible to work with desensitized explosives in order to produce a water-resistant and elastic explosive material.

The present invention, therefore, relates to an explosive material consisting of one or several self-detonating explosives desensitized with wax or water, such as PETN, HMX, TNT or RDX, and one or several inert materials, and is characterized, in that the inert material or a part thereof consists of a rubber of the type silicone rubber or latex rubber, which inert material constitutes matrix or binding agent, and that components comprises after their mixing together constitute a compound, which can be cast, extruded or rolled-out.

As matrix and binding agent, thus, either silicone rubber or latex rubber can be used. Both these materials are innocuous to environment, non-toxic and do not give rise to dangerous temperature increase at curing. They are entirely inert in relation to explosives such as PETN, TNT, HMX or RDX. At casting with silicone rubber or latex, for example, wax-desensitized PETN can be used.

At casting with latex also water-desensitized explosives can be used. Latex rubber, however, is restricted to the casting of thin layers, because it must be possible that water evaporates at the curing. Layers of greater thickness, however, can be obtained by stacking or winding several cured thin layers one upon the other. In the case of silicone as well as latex rubber further additions can be made, for example metal powder for adjusting the density or micro-spheres of plastic or glass for controlling the initiating capacity. Some examples of explosive material according to the invention are described in the following.

EXAMPLE 1

The following ingredients were weighed out and mixed:

37,6% wax-desensitized PETN (7% wax)
15% iron powder
6,4% micro-spheres of glass
41% silicone rubber The mixture was cast in moulds to 25 mm layers. The solidified explosive bodies detonated with the rate 7800 m/s.

EXAMPLE 2

The following ingredients were weighted out and mixed;

87% wax-desensitized PETN
13% latex

The mixture was cast to layer thickness 3 mm. Strips of 16 mm width were initiated with detonator cap and detonated with the rate 7800 m/s.

EXAMPLE 3

A mixture according to Example 1was cast to 3 mm layers. A stack of five strips, 16 mm wide, was detonated with a rate of 3500 m/s.

EXAMPlE 4

A mixture of:

43% water-desensitized HMX 13,17% iron powder
5,9% micro-spheres of glass

The mixture was cast on gauze to a web of 3 mm thickness and after casting was covered by an additional gauze. The gauze was intended as mechanical reinforcement. Five strips of 0 mm width were stacked upon each other and initiated. The detonation rate was measured to be 3400 m/s. When another strip of 50 mm width was wound five turns one upon the other about a cardboard pipe of 100 mm diameter and detonated, the same detonation rate was obtained.

It is, thus, possible to manufacture explosive material with rubber of silicone or latex type in a simple way, which material has different thicknesses and properties. Charges of the type manufactured according to the formula in Example 1 above have proved to readily detonate at a water depth of 450 m, immersed into a water-filled mine. Even charges, which had been lying immersed during the period of one month, could be detonated without problem.

According to a preferred embodiment, the inert material consists, as mentioned, in addition to said rubber of a metal powder and/or hollow micro-spheres of glass or plastic.

According to another preferred embodiment, a mechanical reinforcement of a fabric, wires or fibres of textile material or glass fibres is located cast-in in the explosive material.

The inventor has discovered by experiments, that at explosive material containing latex, rapid solidification on the surface can take place when the material is brought into contact with acetone or alcohol. Strings with a diameter of 7 mm, for example, were extruded down into a bath of acetone, due to the surface solidification, the strings became so manageable that they could be wound on a drying reel. This condition facilitates substantially a mass production of the explosive material.

According to a preferred embodiment, therefore, the explosive material is made so that, when the matrix or binding agent consists of latex, a rapid solidification of the surface of the explosive material has taken place by the effect of a coagulating liquid such as acetone or alcohol.

I claim:

1. An explosive composition comprising: a mixture of at least one wax-desensitized explosive selected from the group consisting of pentaerythritol tetranitrate (PETN), cyclotetramethylenetetranitramine (HMX), trinitrotoluene (TNT) and cyclotrimethylenetrinitramine (RDX), which are wax desensitized, and an inert material, wherein said inert material comprises at least an inert silicone rubber binding agent for said wax-desensitized explosive; whereby said mixture can be shaped and solidified.

2. An explosive composition as defined in claim 1, further comprising at least one material selected from the group consisting of a metal powder, hollow glass micro-spheres and hollow plastic micro-spheres.

3. An explosive composition as defined in claim 1, further comprising a mechanical reinforcement material

4. An explosive composition as defined in claim 3, wherein said mechanical reinforcement material is a fabric.

5. An explosive composition as defined in claim 3, wherein said mechanical reinforcement material comprises wires.

6. An explosive composition as defined in claim 3, wherein said mechanical reinforcement material comprises textile material fibers.

7. An explosive composition as defined in claim 3, wherein said mechanical reinforcement material comprises of glass fiber material.

8. An explosive composition as defined in claim 1, further comprising a metal powder material and at least one material selected from the group consisting of hollow glass micro-spheres and hollow plastic micro-spheres.

* * * * *